US005282770A

United States Patent [19]

Shibata

[11] Patent Number: 5,282,770

[45] Date of Patent: Feb. 1, 1994

[54] VENTILATION SYSTEM

[75] Inventor: Masato Shibata, Nagoya, Japan

[73] Assignee: Kabushiki Kaisha Toshiba, Kawasaki, Japan

[21] Appl. No.: 22,825

[22] Filed: Feb. 24, 1993

Related U.S. Application Data

[63] Continuation of Ser. No. 672,459, Mar. 20, 1991, abandoned.

[30] Foreign Application Priority Data

Mar. 31, 1990 [JP] Japan ..... 2-86008

[51] Int. Cl.[5] ..... F24F 11/04

[52] U.S. Cl. ..... 454/239; 454/67; 454/244

[58] Field of Search ..... 454/56, 67, 239, 242, 454/244, 249, 252

[56] References Cited

U.S. PATENT DOCUMENTS 3,827,343 8/1974 Darm ..... 454/67
4,352,349 10/1982 Yoho ..... 454/239 X
4,773,311 9/1988 Sharp ..... 454/239 X
5,090,303 2/1992 Ahmed ..... 454/239 X

FOREIGN PATENT DOCUMENTS 584874 10/1959 Canada ..... 454/249
48009 9/1980 Japan ..... 454/239
144345 11/1981 Japan ..... 454/249
1-50825 10/1989 Japan .

*Primary Examiner*—Harold Joyce
*Attorney, Agent, or Firm*—Limbach & Limbach

[57] ABSTRACT

A ventilation system includes a ventilator of a simultaneous suction and exhaust type, ducts communicating the ventilator to respective air inlet and air outlet formed at one room or each of a plurality of rooms, dampers provided in the ducts respectively, and a control device responsive to signals indicative of operating conditions of items of equipment provided in the one or plurality of rooms for controlling operation of the ventilator and opening and closure of each damper in accordance with the operating conditions of the items of equipment.

7 Claims, 6 Drawing Sheets

VENTILATION SYSTEM

This is a continuation of co-pending application Ser. No. 07/672,459 filed on Mar. 20, 1991, abandoned.

BACKGROUND OF THE INVENTION

This invention relates to a ventilation system in which operation of a ventilator is controlled in accordance with operating conditions of a plurality of equipments provided in one or more rooms to be ventilated.

Environmental changes in one or more rooms are detected by a gas sensor, a human body detector, a temperature sensor or the like in conventional ventilators so that an amount of ventilation is controlled, thereby enhancing saving energy. Japanese Published Patent Application No. 1-50825 discloses such a ventilator as described above.

However, detection accuracy of the gas sensor differs depending upon kinds of gas materials employed in the sensor. In the case of the human body detector, the detection accuracy differs depending upon the temperature and humidity of an atmosphere in the room to be ventilated. Furthermore, degree of filthiness of air in the room to be ventilated cannot be sensed by the temperature sensor in accordance with operating conditions of one or more equipments used in the room, for example, a cooking range, a kerosene stove or the like. Consequently, an actual amount of ventilation becomes smaller or larger than an optimum amount in accordance with the operating conditions of the equipments used in the room.

SUMMARY OF THE INVENTION

Therefore, an object of the present invention is to provide a ventilation system in which operation of the ventilator is controlled in accordance with operating conditions of equipments provided in one or more rooms to be ventilated so that an optimum amount of ventilation can always be obtained with the result that saving energy is enhanced and the rooms are ventilated such that it is comfortable in each room.

To achieve the above-described object, the present invention provides a ventilation system comprising a ventilator of a simultaneous suction and exhaust type, ducts communicating the ventilator to respective air inlet and air outlet formed at one room or each of a plurality of rooms, dampers provided in the ducts respectively, and a control device responsive to signals indicative of operating conditions of items of equipment provided in the one or plurality of rooms for controlling operation of the ventilator and opening and closure of each damper in accordance with the operating conditions of the items of equipment.

In accordance with the above-described ventilation system, operation of the ventilator is controlled by the control device in accordance with the operating conditions of a plurality of equipments so that an optimum amount of ventilation can always be obtained. Consequently, the rooms can be ventilated such that it is comfortable in the rooms and yet, the energy saving can be enhanced.

It is preferable that the signals indicative of the operating conditions of the equipments include on-off switching signals of each equipment or on-off switching signals and operation mode switching signals of each equipment. Consequently, the operating condition of each equipment can be determined readily and accurately.

The control device may comprise storage means for storing data of an amount of ventilation set in accordance with the operating condition of each equipment and calculating means for calculating an amount of ventilation based on the data stored in the storage means. Consequently, the amount of ventilation can be controlled more readily and accurately. Furthermore, when the setting means is provided for storing in the storage means desirable data of the amount of ventilation set in accordance with the operating condition of each equipment, changes in the number and kinds of the equipments provided in each room can be properly dealt with.

Furthermore, the control device may operate to control an amount of opening of each damper based on the signal indicative of the operating condition of the equipment. More accurate ventilation control can thus be provided for each room.

When the room is provided with a plurality of equipments including at least one exhaust fan, a duct may be provided in the room so as to communicate the ventilator to the air inlet formed in the room, a damper may be provided in the duct, and the control device may control operations of the ventilator and the exhaust fan and opening and closure of the damper. Consequently, ventilation of the room can be efficiently performed by effectively using both the exhaust ventilation fan and the ventilator. In this case, too, the ducts may be provided with the respective dampers and the control device may operate to control an amount of opening of each damper based on the signal indicative of the operating condition of each equipments. Additionally, the control device may also operate to control an amount of opening of each damper based on the signal indicative of the operating condition of each equipment.

Other objects of the present invention will become obvious upon understanding of the illustrative embodiment about to be described with reference to the accompanying drawings. Various advantages not referred to herein will occur to one skilled in the art upon employment of the invention in practice.

DESCRIPTION OF THE PREFERRED EMBODIMENT

Figure 1:
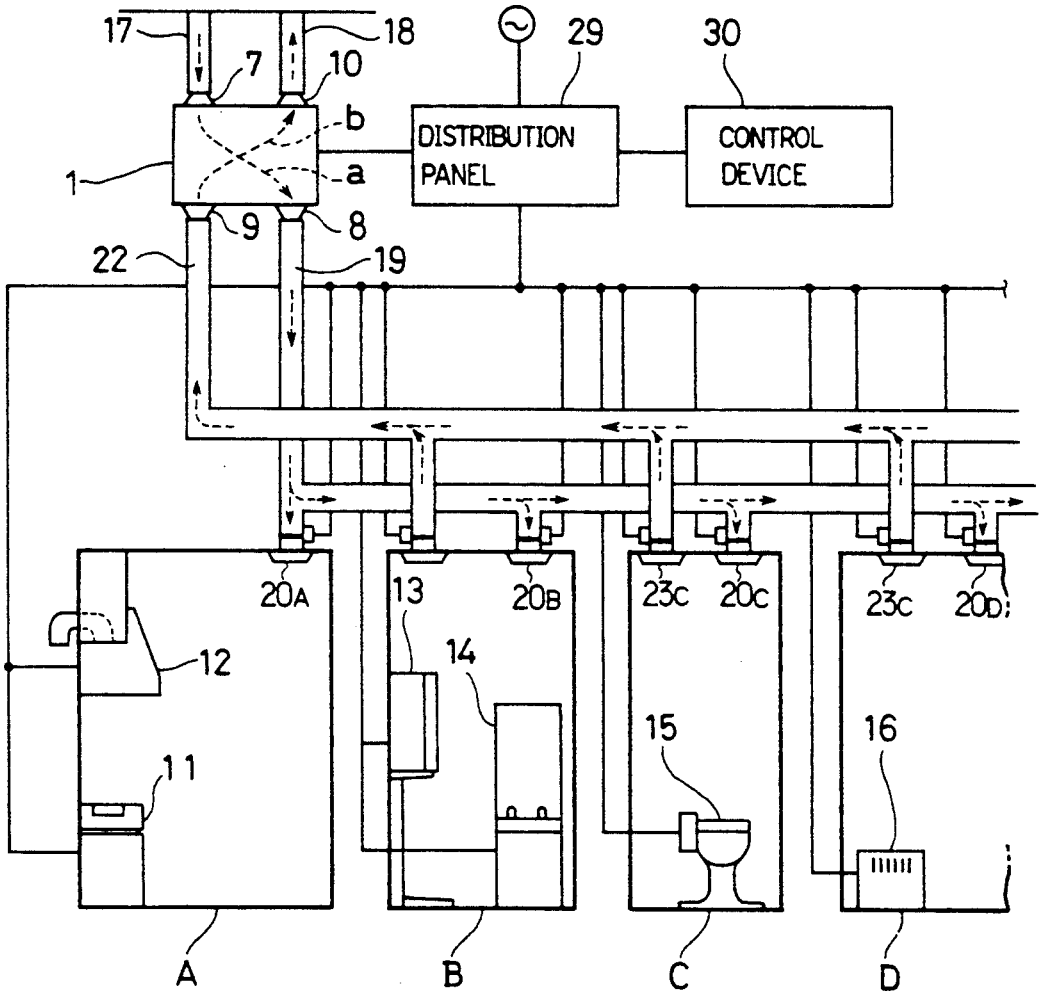
FIG. 1 is schematic side view of a ventilation system of an embodiment in accordance with the present invention.
Figure 2:
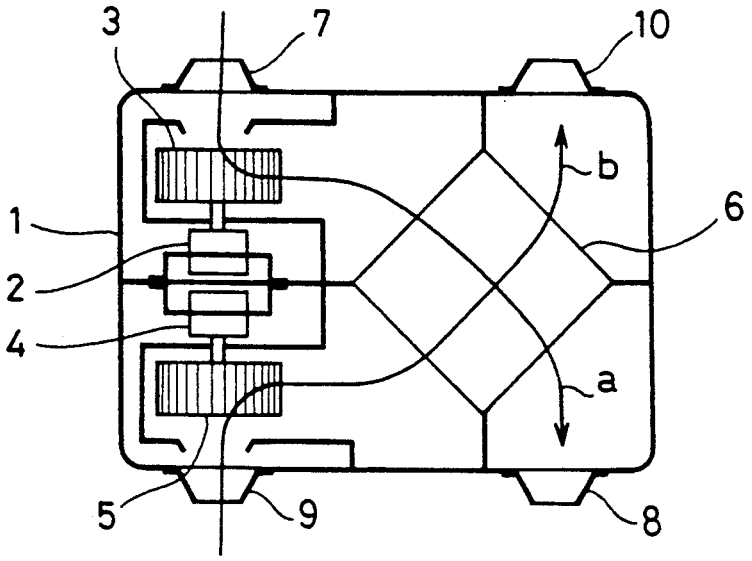
FIG. 2 is a schematic side elevation of a ventilator employed in the ventilation system.

An embodiment of the present invention will be described with reference to the accompanying drawings. Referring to FIG. 1, reference numeral 1 designates a ventilator of the simultaneous suction and exhaust type serving as an air conditioning equipment. The ventilator 1 is provided on the backside of a ceiling of a house or the like. The ventilator 1 comprises a suction fan 3 driven by a suction motor 2, an exhaust fan 5 driven by an exhaust motor 4 and a heat exchanger 6, as shown in FIG. 2. An outdoor air is introduced through an inlet 7 by the suction fan 3 and delivered through the heat exchanger 6 and an outlet 8 as shown by an arrow a in FIG. 2. An indoor air is introduced through an inlet 9 by the exhaust fan 5 and delivered through the heat exchanger 6 and an outlet 10 as shown by an arrow b in FIG. 2. These outdoor air suction and indoor air exhaust operations are performed simultaneously such that heat exchange is performed between the indoor and outdoor air.

Reference characters A through D in FIG. 1 designate a kitchen, a washroom, a lavatory and a living room, respectively. A cooking range 11 as an equipment is provided in the kitchen A. A range hod fan 12 serving as an exhaust fan is disposed over the cooking range 11. A clothes drier 13 and a wash stand 14 each as an equipment are provided in the washroom B. A stool or toilet 15 with a warm toilet-seat having a hot-water cleaning function is provided in the lavatory C. A kerosene stove or space heater 16 as an equipment is disposed in the living room D.

Figure 3:
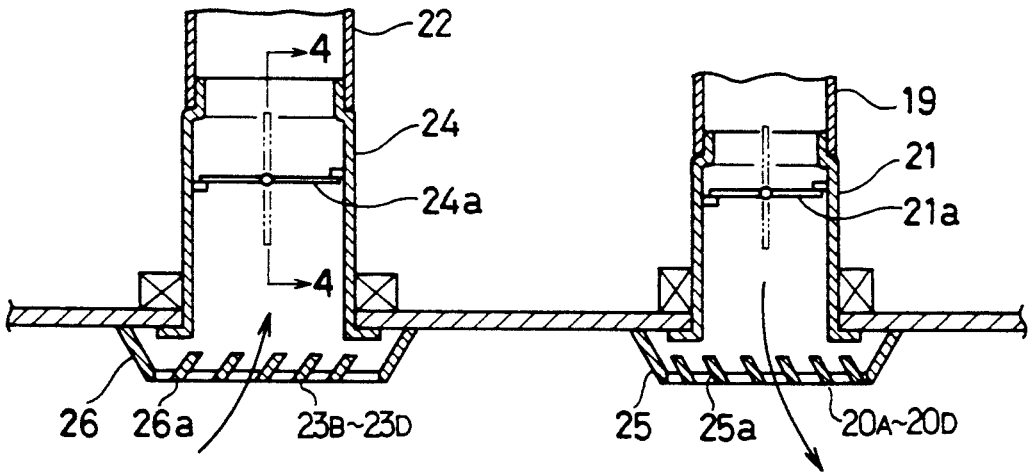
FIG. 3 is a longitudinal section of inlet and outlet dampers employed in the ventilation system.
Figure 4:
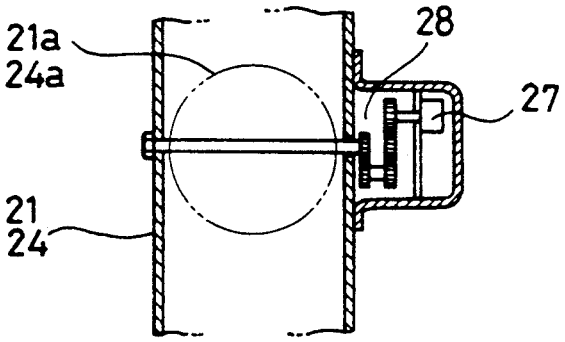
FIG. 4 is a view taken along line 4—4 in FIG. 3.
Figure 5:
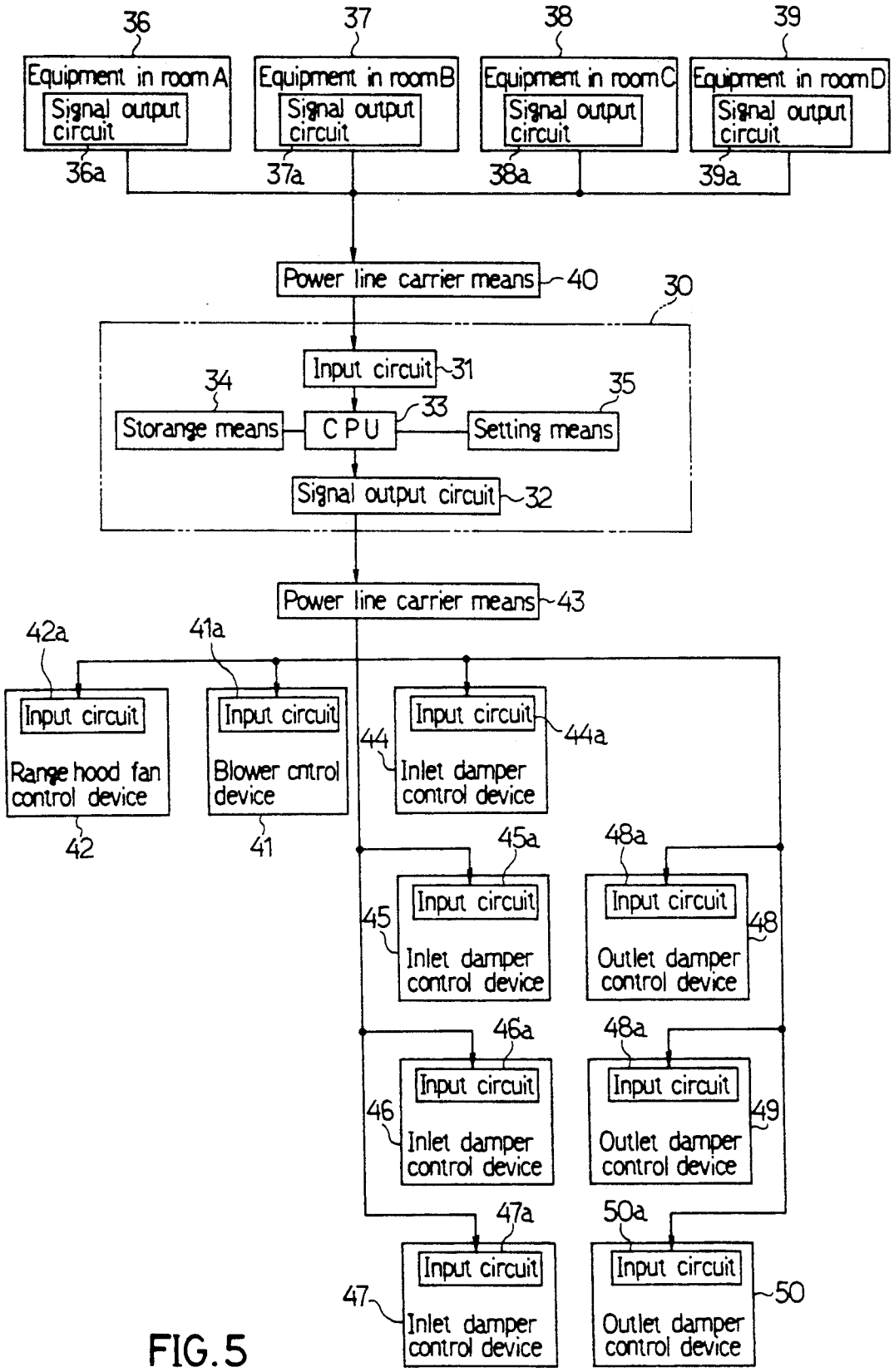
FIG. 5 is a block diagram showing an arrangement of a control circuit of the ventilation system.

Ducts 17 and 18 connected to the inlet 7 and outlet 10 respectively are communicated to the outdoors. A duct 19 connected to the outlet 8 is further connected to cylindrical inlet members 21 (FIG. 3) forming a part of a duct connected to inlet openings 20A, 20B, 20C and 20D of the kitchen A, washroom B, lavatory C and living room D respectively. A duct 22 connected to the inlet 9 is further connected to cylindrical outlet members 24 (FIG. 3) forming a part of a duct connected to outlet openings 23B, 23C and 23D of the washroom B, lavatory C and living room D respectively. Each cylindrical inlet member 21 has an inlet damper 21*a* and each cylindrical outlet member 24 has an outlet damper 24*a*. An inlet grille 25 is mounted on the indoor side of the cylindrical inlet member 21 and an outlet grille 26 is mounted on the indoor side of the cylindrical outlet member 24. The grilles 25 and 26 have inclined guide plates 25*a* and 26*a* and a direction of inclination of the guide plates 25*a* is opposite to a direction of inclination of the guide plates 26*a*, as shown in FIG. 3. Degree of opening of each of the inlet and outlet dampers 21*a*, 24*a* is adjusted by transmitting torque of a motor 27 to a reduction gear mechanism 28, as shown in FIG. 4. The directions of airflow through the respective ducts 17, 18, 19 and 22 are shown by broken line arrows in FIG. 1.

Referring further to FIG. 1, reference numeral 29 designates a distribution panel receiving a commercial electric power. The commercial power is supplied from the distribution panel 29 through power supply lines to the cooking range 11, the range hood fan 12, the clothes drier 13, the wash stand 14, the toilet 15, the kerosene stove 16 and the like. The commercial power is also supplied to the motor 27 driven for adjusting the degree of opening of the inlet dampers 21*a* of the respective inlet openings 20A–20D and the outlet dampers 24*a* of the respective outlet openings 22B–22D and the suction and exhaust motors 2, 4 of the ventilator 1.

A control device 30 connected to the distribution panel 29 comprises an input circuit 31, a signal output circuit, a central processing unit (CPU) 33 as calculating unit, storage means 34 and setting means 35 for setting a necessary amount of ventilation (a quantity of exhaust air in accordance with operating conditions of the equipments). Data set by the setting means 35 is previously stored in the storage means 34. More specifically, the data are indicative of a quantity of air sent by each of the range hood fan 12 and the ventilator 1 in accordance with operating conditions of various equipments, that is, the cooking range 11, the clothes drier 13, the wash stand 14, the toilet 15, the kerosene stove 16 and the like. In this respect, $q_{A1}$ and $q_{R1}$ in the stored data represent a quantity of air sent into the kitchen A by the ventilator 1 and an quantity of air exhausted from the kitchen A by the range hood fan 12 respectively in the case where the cooking range 11 is being operated in a high-power mode. The quantity of air sent into the kitchen A by the ventilator 1 and the quantity of air exhausted from the kitchen A by the range hood fan 12 are represented by $q_{A2}$ and $q_{R2}$ respectively in the case where the cooking range 11 is being operated in a usual mode not in the high-power mode.

The quantity of air sent into the washroom B by the ventilator 1 is represented by $q_{B1}$ in the case where the clothes drier 13 is being operated in the high-power mode with the wash stand 14 turned on. The quantity of air sent into the washroom B by the ventilator 1 is represented by $q_{B2}$ in the case where only the clothes drier 13 is being operated in the high-power mode. When the clothes drier 13 is being operated in the usual mode not in the high-power mode with a wash stand 14 power switch turned on, the quantity of air sent into the washroom B by the ventilator 1 is represented by $q_{B3}$. When the wash stand power switch is turned off with the clothes drier 13 being operated in the usual mode, the quantity of air sent into the washroom B by the ventilator 1 is represented by $q_{B4}$. The quantity of air sent into the washroom B by the ventilator 1 is represented by $q_{B5}$ in the case where the clothes drier 13 is turned off and the wash stand power switch is turned on. When the power switches of both the clothes drier 13 and the wash stand are turned off, the quantity of air sent into the washroom B by the ventilator 1 is represented by 0.

Furthermore, the quantity of air sent into the toilet C by the ventilator 1 is represented by $q_{C1}$ in the case where a toilet-seat power switch of the toilet 15 is turned on. When the toilet-seat power switch is turned off, the quantity of air sent into the toilet C by the ventilator 1 is represented by 0.

Additionally, the quantity of air sent into the living room D by the ventilator 1 is represented by $q_{D1}$ in the case where a power switch of the kerosene stove 16 is turned on. When the kerosene stove power switch is turned off, the quantity of air sent into the living room D by the ventilator 1 is represented by 0.

Operation information means 36, 37, 38 and 39 are provided in the kitchen A, washroom B, lavatory C and living room D respectively for detecting on-off state and operation mode of the equipments provided in the respective rooms.

The operation information means 36–39 have signal output circuits 36*a*–396*a* respectively for processing detected signals. The signals processed by the respective signal output circuits 36*a*–*3pa* are supplied to an input circuit 31 of the control device 30 via the respective power supply lines for supplying the electric power to the respective equipments by known power line carrier means 40.

Operation control devices 41 and 42 are provided in the ventilator 1 and the range hood fan 12 respectively. The operation control devices 41 and 42 have input circuits 41*a* and 42*a* respectively. Operation control signals generated by the signal output circuit 32 of the control device 30 are supplied to the input circuits 41a and 42a via known power line carrier means 43. Inlet damper control devices 44 through 47 are provided in the kitchen A, the lavatory B, the toilet C and the living room D for controlling the degree of opening of the inlet dampers provided in inlet duct 19 communicated to these rooms, respectively. The damper control devices 44–47 have input circuits 44a –47a which are supplied with the operation control signals from the signal output circuit 32 of the control device 30 via the power line carrier means 43, respectively. Outlet damper control devices 48 through 50 are provided in the washroom B, the lavatory C and the living room D for controlling the degree of opening of each inlet damper 24a provided in the outlet duct 22 communicated to these rooms, respectively. The outlet damper control devices 48–50 have input circuits 48a –50a supplied with the operation control signals from the signal output circuit 32 of the control device 30 via the power line carrier means 43.

Figure 6:
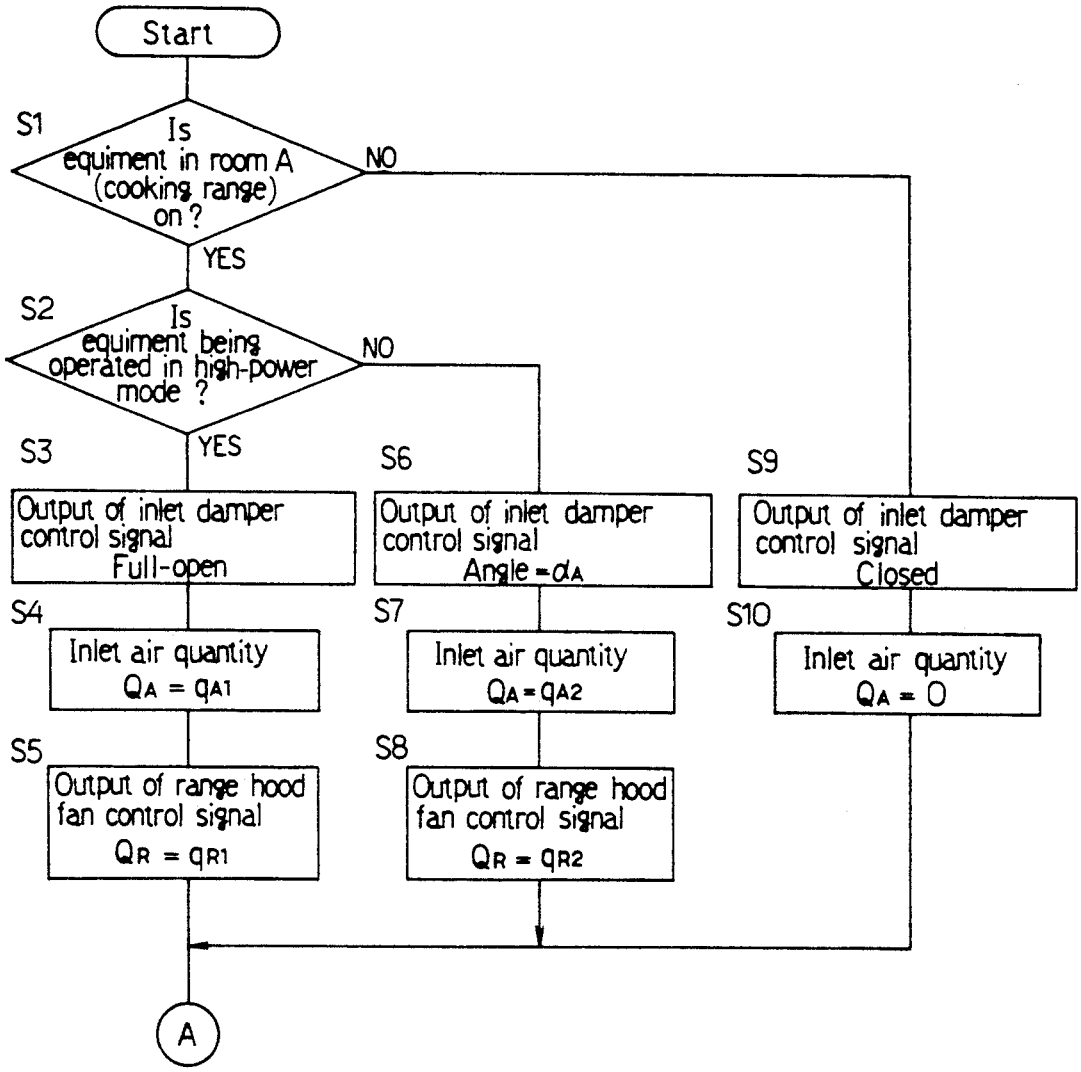
FIGS. 6(*a*) through 6(*c*) are flowcharts showing control manners of the control circuit of the ventilation system.
Figure 6:
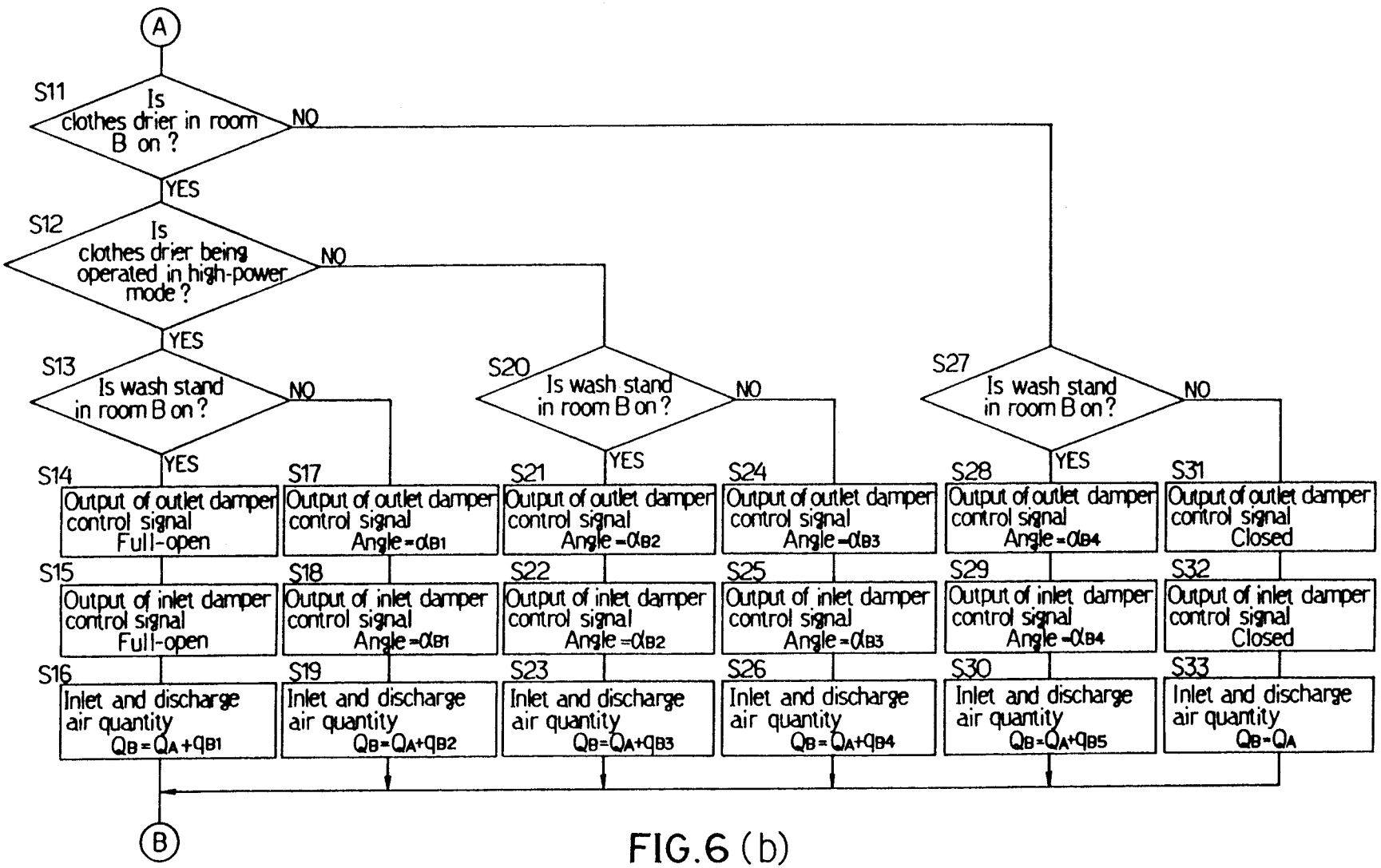
Figure 6:
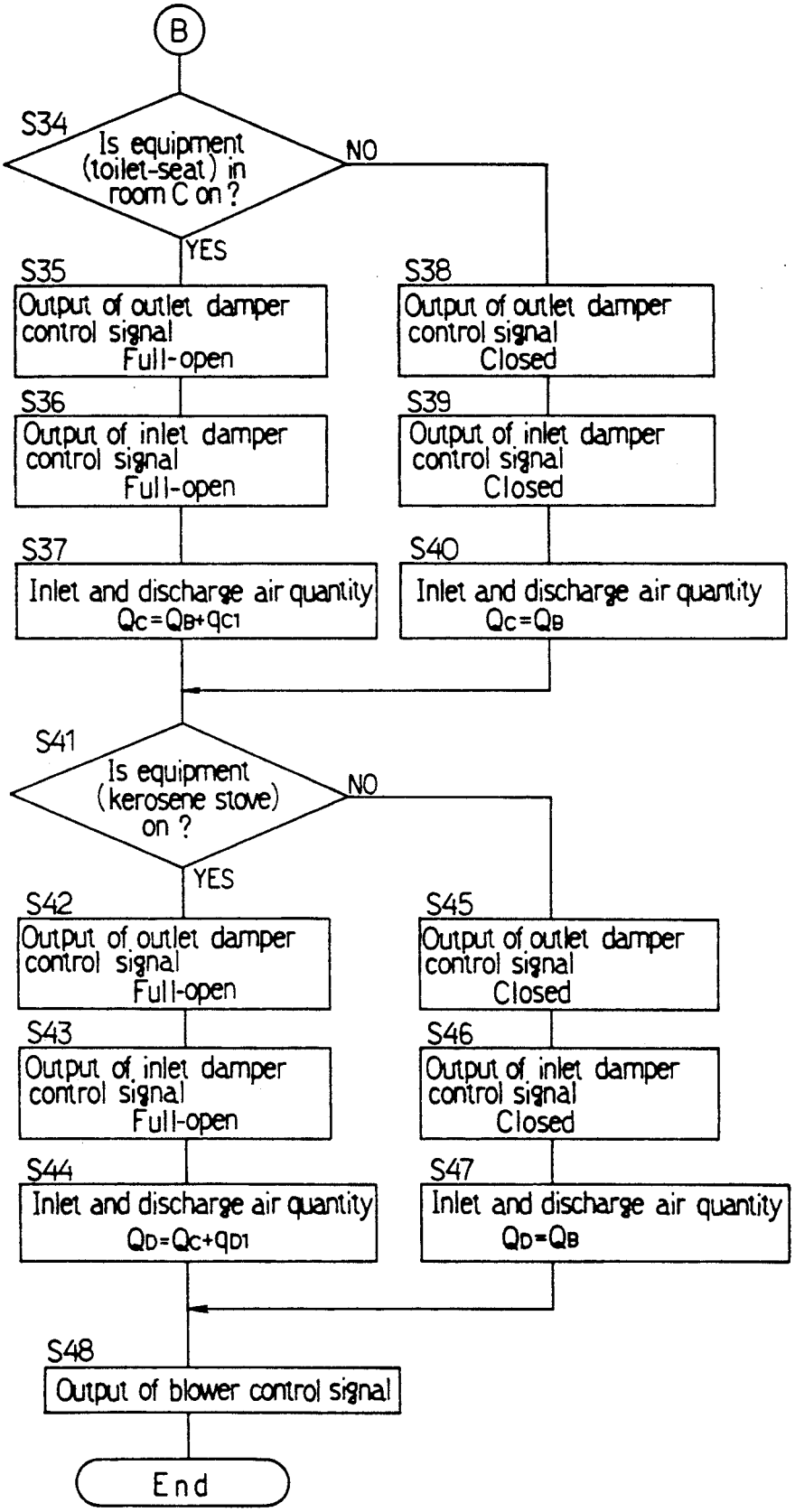

Operation of the ventilation system will be described with reference to flowcharts of FIGS. 6(*a*) through 6(*c*).

(1) Operation with respect to the kitchen A:

First, it is determined whether or not a driving switch of the cooking range 11 provided in the kitchen A is turned on or the cooking range 11 is in operation, at step S1. It is determined at step S2 whether or not the cooking range 11 is being operated in the high-power mode when it is determined at step S1 that the cooking range 11 is in operation. When it is determined that the cooking range 11 is in the high-power mode, the control device 30 operates to supply the damper control device 43 with the signal so that the inlet damper 21a for the kitchen A is full-opened, at step S3, thereby full-opening the inlet damper 21a. Subsequently, the control device 30 operates to set a quantity $Q_A$ of air sent into the kitchen A by the ventilator 1 to $Q_A=q_{A1}$, at step S4. The control device 30 then operates to supply the signal to the operation control device 42 of the range hood fan 12 so that a quantity $Q_R$ of air exhausted by the range hood fan 12 is set to $Q_R=q_{R1}$, at step S5. Consequently, the quantity of air exhausted by the range hood fan 12 is controlled so as to correspond to the quantity represented by $q_{R1}$.

When it is determined at step S2 that the cooking range 11 is not in the high-power mode, the control device 30 operates to supply the damper control device 44 with the control signal so that the inlet damper 21a for the kitchen A is controlled so as to take an angle $a_A$, at step S6, thereby setting the inlet damper 21a to the angle $_A$. The control device 30 then operates to set the quantity of air sent into the kitchen A by the ventilator 1 to $Q_A=q_{A2}$, at step S7. The control device 30 then operates to supply the signal to the operation control device 42 of the range hood fan 12 so that the quantity of air exhausted from the kitchen A by the range hood fan 12 is set to $Q_R=q_{R2}$, at step S8. Consequently, the quantity $Q_R$ of air exhausted by the range hood fan 12 is controlled so as to take the quantity represented by $q_{R2}$.

When it is determined at step S1 that the cooking range 11 is not operated, the control device 30 operates to supply the control signal to the inlet damper control device 44 so that the inlet damper 21a is completely closed. Then, at step S10, the control device 30 operates to set the quantity $Q_A$ to $Q_A=0$.

Setting the ventilation mode for the kitchen A is completed upon completion of the operation at step S5, S8 or S10, as described above. The control device 30 advances to step S11 for setting the ventilation mode for the washroom B.

(2) Operation with respect to the washroom B:

First, it is determined whether or not a driving switch of the clothes drier 13 provided in the washroom B is turned on or the clothes drier 13 is in operation, at step S11. It is determined at step S12 whether or not the clothes drier 13 is being operated in the high-power mode when it is determined at step S11 that the clothes drier 13 is in operation. When it is determined that the clothes drier 13 is in the high-power mode, it is determined whether or not a power switch of the wash stand 14 is turned on, at step S13. When it is determined at step S13 that the wash stand 14 power switch is turned on, the control device 30 operates to supply the outlet damper control device 48 with the control signal so that the outlet damper 24a for the washroom B is full-opened, at step S14, thereby full-opening the outlet damper 24a. Then, the control device 30 operates to supply the control signal to the inlet damper control device 45 so that the inlet damper 21a for the washroom B is full-opened, at step S 15, thereby full-opening the inlet damper 21a. The control device 30 then operates to set the quantity of inlet and discharge air sent into and discharged from the washroom B by the ventilator 1 to $Q_B=Q_A+q_{B1}$, at step S16.

When it is determined at step S13 that the wash stand power switch is not turned on, the control device 30 operates to supply the control signal to the outlet damper control device 48 so that the outlet damper 24a for the washroom B is opened at an angle $a_{B1}$, at step S17, thereby opening the outlet damper 24a at the angle $a_{B1}$. Then, at step S18, the control device 30 operates to supply the control signal to the inlet damper control device 45 so that the inlet damper 21a for the washroom B is opened at the angle $a_{B1}$, thereby opening the inlet damper 21a at the angle $a_{B1}$. The control device 30 then operates to set the quantity $Q_B$ of inlet and discharge air by the ventilator 1 to $Q_B=Q_A+q_{B2}$, at step S19.

When it is determined at step S12 that the clothes drier 13 is not in the high-power mode, it is determined whether or not the wash stand power switch is turned on, at step S20. When it is determined that the wash stand power switch is turned on, the control device 30 performs steps S21–S23 in the same manners as in the above-described steps S17–S19 respectively. The outlet damper 24a is opened at the angle $a_{B2}$ at step S21 and the inlet damper 21a is opened at the angle $a_{B2}$ at step S22. Then, the quantity $Q_B$ of inlet and discharge air by the ventilator 1 is set to $Q_B=Q_A+q_{B3}$, at step S23.

When it is determined at step S20 that the wash stand power switch is not turned on, the control device 30 performs steps S24, S25 and S26 in the same manners as in steps S21–S23 respectively. The outlet damper 24a is opened at the angle $a_{B3}$ at step S24 and the inlet damper 21a is opened at the angle $a_{B3}$ at step S25. Then, the quantity $Q_B$ of inlet and discharge air by the ventilator 1 is set to $Q_B=Q_A+q_{B4}$.

When it is determined at step S11 that the clothes drier 13 is not in operation, the control device 30 advances to step S27 which is the same as the steps S13 and S20. When it is determined that the wash stand power switch is turned on, the control device 30 performs steps S28, S29 and S30 in the same manners as in steps S24–S26 respectively. The outlet damper 24a is opened at the angle $a_{B4}$ at step S28 and the inlet damper 21a is opened at the angle $a_{B4}$ at step S29. Then, the quantity $Q_B$ of inlet and discharge air by the ventilator 1 is set to $Q_B=Q_A+q_{B5}$ at step S30.

When it is determined at step S27 that the wash stand power switch is not turned on, the control device 30 performs steps S31, S32 and S33 in the same manners as in steps S28–S30 respectively. The outlet damper 24*a* is completely closed at step S31 and the inlet damper 21*a* is completely closed, too, at step S32. Then, the quantity $Q_B$ of inlet and discharge air by the ventilator 1 is set to $Q_B=Q_A$ at step S33.

Setting the ventilation mode for the washroom B is completed upon completion of the operation at step S16, S19 or S23, S26, S30 or S33 as described above. The control device 30 advances to step S34 for setting the ventilation mode for the lavatory C.

(3) Operation with respect to the lavatory C:

It is determined whether or not a toilet-seat switch of the toilet 15 as the equipment provided in the lavatory C is turned on, at step S34. When it is determined that the toilet-seat switch is turned on, the control device 30 performs steps S35, S36 and S37 in the same manners as in steps S14–S16 respectively. The outlet damper 24*a* is full-opened at step S35 and the inlet damper 21*a* is full-opened at step S36. Then, the quantity $Q_C$ of inlet and discharge air by the ventilator 1 is set to $Q_C=Q_B+q_{C1}$ at step S37.

When it is determined at step S34 that the toilet-seat switch is not turned on, the control device 30 performs steps S38, S39 and S40 in the same manners as in steps S35–S37 respectively. The outlet damper 24*a* is completely closed at step S38 and the inlet damper 21*a* is completely closed, too, at step S39. then, the quantity $Q_C$ of inlet and discharge air by the ventilator 1 is set to $Q_C=Q_B$.

Setting the ventilation mode for the lavatory C is thus completed upon completion of the operation at step S37 or S40 as described above. The control device 30 advances to step S41 for setting the ventilation mode for the living room D.

(4) Operation with respect to the living room D:

It is determined whether or not a power switch of the kerosene stove 16 as the equipment disposed in the living room D is turned on or the kerosene stove 16 is in operation, at step S41. When it is determined that the kerosene stove power switch is turned on, the control device 30 performs steps S42, S43 and S44 in the same manners as in S35–S37 respectively. The outlet damper 24*a* is full-opened at step S42 and the inlet damper 21*a* is full-opened at step S43. Then, the quantity $Q_D$ of inlet and discharge air by the ventilator 1 is set to $Q_D=Q_C+q_{D1}$ at step S44.

When it is determined at step S41 that the kerosene stove power switch is not turned on, the control device 30 performs steps S45, S46 and S47 in the same manners as in steps S38–S40 respectively. The outlet damper 24*a* is completely closed at step S45 and the inlet damper 21*a* is completely closed, too, at step S46. then, the quantity $Q_D$ of inlet and discharge air by the ventilator 1 is set to $Q_D=Q_B$.

Upon completion of step S44 or S47, the control device 30 advances to step S48 at which a blower control signal for setting the amount of inlet and outlet air by the ventilator 1 to $Q_D$ is transmitted. More specifically, the signal from the signal output circuit 32 of the control device 30 is supplied to the input circuit 41*a* of the operation control device 41 of the ventilator 1 via the power line carrier means 43. Consequently, the inlet and outlet motors 2, 4 of the ventilator 1 are controlled so as to produce the quantity of air based on the supplied signal and accordingly, a quantity of inlet and discharge air for each room is controlled in accordance with the equipment in operation in each room. The above-described steps S1–S48 are repeated periodically such that operation of the ventilator 1 is controlled to always obtain an optimum amount of ventilation in accordance with changes in the operating conditions of the equipments.

In accordance with the above-described embodiment, the control device 30 is supplied with the signals indicative of the operating conditions of a plurality of equipments such as the cooking range 11, clothes drier 13, wash stand 14, toilet 15, kerosene stove 16 and the like. The control device 30 operates to calculate a quantity of inlet and discharge air sent into and discharge from each room by the ventilator 1 based on these signals and to control operation of the ventilator or the quantity of inlet and discharge air sent into and discharged from each room by the ventilator 1 in accordance with the result of calculation. Consequently, operation of the ventilator 1 is controlled so that an optimum amount of ventilation is always obtained in accordance with the operating conditions of the equipments. Thus, saving of energy can be achieved and yet, the rooms can be ventilated such that it is comfortable in each room.

Since the on-off switching signals or the on-off switching signals and the operation mode switching signals of each equipment are supplied to the control device 1 as the signals indicative of the operating conditions of the equipments, determination of the operating condition of each equipment can be performed readily and exactly.

The control device 30 comprises the storage means for storing setting data of the amount of ventilation in accordance with the operating conditions of the equipments provided in the rooms A–D and CPU 33 as the calculating means for calculating the amount of ventilation based on the data stored in the storage means. The amount of ventilation can be controlled accurately as compared with the case where the ventilation amount is controlled based on data of the number of equipments in operation and the like. However, since an expected object can be achieved to some extent even when the amount of ventilation is controlled based on the number of equipments in operation and the like, the present invention should not be limited to the above-described arrangement.

The storage means 34 is provided with the setting means 35 for storing desirable data in the storage means 34. When the equipments provided in the rooms A–D are changed or when other equipments are newly provided in the rooms, the setting means 35 is operated to change the data stored in the storage means 34 or to add new data to the same. Thus, the changes or addition of the equipments can be dealt with advantageously.

One or two equipments are provided in each of the rooms A–D and the inlets 20A–20D and outlets 23B–23D of the respective rooms are communicated through the ducts 19, 22 to the simultaneous suction and exhaust type ventilator 1. Consequently, a plurality of rooms can be ventilated by a single ventilator.

Furthermore, the ducts 19, 22 are provided with the dampers 21*a*, 24*a* respectively. An amount of opening of each damper is controlled by the control device 30 in accordance with the operating conditions of the equipments. Consequently, the ventilating operation can be performed for only one of the rooms actually necessary to be ventilated and an amount of ventilation for each room can be controlled so as to take a minimum value, thereby providing an efficient ventilating control.

Since the amount of opening of each damper 21*a*,24*a* is controlled by the control device 30, further accurate ventilating control can be provided.

In the case of the kitchen A where the range hood fan as an exhaust fan is provided in addition to the equipment or the cooking range 11, the operation of both of the ventilator 1 and the range hood fan 12 is controlled by the control device 30. Consequently, the ventilation of the kitchen A can be performed by effectively utilizing both of the range hood fan 12 and the ventilator 1. In this case, the inlet damper 21*a* is provided in the duct 10 communicated to the inlet 20A of the kitchen A. Since the opening and closing and an amount of opening of the inlet damper 21*a* are controlled by the control device 30, ventilation of the kitchen A can be controlled with further accuracy.

The control means for controlling the amount of opening of each of the inlet damper 21*a* and the outlet damper 24*a* may be provided in case of need and further, may be provided for one or some of the rooms necessitating such a control.

The foregoing disclosure and drawings are merely illustrative of the principles of the present invention and are not interpreted in a limiting sense. The only limitation is to be determined from the scope of the appended claims.

I claim:

1. A ventilation system comprising:

a) a ventilator for simultaneous suction and exhaust, the ventilator comprising an air inlet fan and an air outlet fan both enclosed in a single cabinet;

b) a plurality of ducts communicating the ventilator to each air inlet and air outlet formed at a plurality of rooms respectively;

c) a plurality of dampers provided in the ducts respectively; and d) a control device responsive to signals indicative of operating conditions of one or more items of equipment provided in the rooms respectively for controlling an operation of the ventilator and opening and closing each damper in accordance with the operating conditions of the one or more items of equipment, the control device including storage means for storing data of an amount of ventilation set in accordance with the operating conditions of the items of equipment and calculating means for calculating an amount of ventilation based on the data stored in the storage means.

2. A ventilation system according to claim 1, wherein the signals indicative of the operating conditions of the items of equipment include on-off switching signals of each item of equipment.

3. A ventilation system according to claim 1, wherein the signals indicative of the operating conditions of the items of equipment include on-off switching signals and operation mode switching signals of each item of equipment.

4. A ventilation system according to claim 1, which further comprises setting means for storing in the storage means desirable data of the amount of ventilation set in accordance with the operating conditions the items of equipment.

5. A ventilation system according to claim 1, wherein the control device operates to control the opening of each damper based on the signal indicative of the operating conditions of the items of equipment.

6. A ventilation system according to claim 1, wherein the room is provided with items of equipment including at least one exhaust fan, and which further comprises a duct communicating the ventilator to the air inlet formed in the room and a damper provided in the duct, the control device controlling operations of the ventilator and the exhaust fan and opening and closure of the damper.

7. A ventilation system according to claim 6, wherein the control device operates to control an amount of opening of the damper based on the signals indicative of the operating conditions of the items of equipment.

* * * * *